United States Patent [19]

Telchuk et al.

[11] Patent Number: 5,074,238

[45] Date of Patent: Dec. 24, 1991

[54] PRODUCTION LINE PAINT SPRAY BOOTH WITH DUAL SLOTS

[75] Inventors: Steve E. Telchuk, Buffalo Grove; Leslie H. Brown, Carol Stream, both of Ill.

[73] Assignee: Binks Manufacturing Company, Franklin Park, Ill.

[21] Appl. No.: 528,106

[22] Filed: May 23, 1990

[51] Int. Cl.[5] ..... B05B 15/12

[52] U.S. Cl. ..... 118/326; 55/DIG. 46; 118/DIG. 7; 261/118; 454/50

[58] Field of Search ..... 118/326, DIG. 7; 427/421, 424; 55/240, 241, DIG. 46; 98/115.2; 261/112.1, 118, DIG. 54

[56] References Cited

U.S. PATENT DOCUMENTS

| | | | |
|---|---|---|---|
| 2,719,705 | 10/1955 | Watson | 261/112.1 X |
| 3,168,029 | 2/1965 | Dock et al. | 98/115.2 |
| 3,561,135 | 2/1971 | Fulford | 118/326 X |
| 3,807,291 | 4/1974 | Roberts et al. | 98/115.2 |
| 3,965,805 | 6/1976 | Muehlbauer | 55/240 X |
| 4,133,255 | 1/1979 | Guice | 118/DIG. 7 |
| 4,328,012 | 5/1982 | Telchuk, Jr. et al. | 55/241 X |
| 4,521,227 | 6/1985 | Gerdes et al. | 98/115.2 X |
| 4,664,061 | 5/1987 | Morioka et al. | 55/DIG. 46 |
| 4,700,615 | 10/1987 | Napadow | 98/115.2 |
| 4,726,287 | 2/1988 | Gerdes et al. | 261/118 X |

*Primary Examiner*—Richard L. Chiesa

*Attorney, Agent, or Firm*—Juettner Pyle & Lloyd

[57] ABSTRACT

An improvement for a production line, downdraft type paint spray booth having a conveyor for carrying the parts to be painted, having a recessed portion for containing the conveyor and dual slots, on one or either side of the conveyor for air flow is disclosed.The improvement provides the advantage of improved air flow around the parts being painted and around the conveyor to keep it clean. Additionally, the provision of the dual slots permits the conveyor to be at least partially recessed into the booths floor to provide a lower profile and a more compact arrangement.

13 Claims, 3 Drawing Sheets

PRODUCTION LINE PAINT SPRAY BOOTH WITH DUAL SLOTS

This invention relates to downdraft paint spray booths and particularly production type booths of the type having conveyor lines therein for carrying the parts to be painted.

BRIEF DESCRIPTION OF PRIOR ART

Heretofore it has been known to provide a downdraft type booth with a conveyor line for carrying the parts or articles to be painted through the booth. Generally many conveyor lines were set on the booth's grill floor, or more accurately, the structural supports carrying the grill floor. Generally, below the grill floor and structural supports a center draw slot was provided for withdrawing the air from the paint spraying space or chamber above the floor to be subsequently cleaned. Beneath the grill floor were usually sloped sheets forming a subfloor, which in operation were water washed, and they funneled the air from the booth and the water on the subfloor into the center slot. Examples of such booths are U.S. Pat. Nos. 4,328,012 (see reference numeral 12 therein), 4,521,227 or 4,726,287. While conveyors are not shown in all the patents, the commercial booths built based on these patents did have conveyor means above the single slot water washed subfloors.

Other spray booths have different somewhat related, arrangements: See U.S. Pat. No. 2,719,705 showing a conveyorless booth for painting a plurality of railroad cars, U.S. Pat. No. 3,168,029 showing a booth with dual slots but with the conveyor arranged above the floor, U.S. Pat. No. 3,965,805 showing a dual slot conveyorless booth with a work space in the center to house a man for painting the underside (bottom) of an article; and U.S. Pat. No. 4,133,255 showing a booth with an exhaust duct at each side of the booth for painting automobiles, there being no conveyor.

SUMMARY OF THE PRESENT INVENTION

The present invention is for a production line paint spray booth having a paint spraying chamber, a water washed floor or subfloor below the paint spraying chamber, said subfloor forming dual slots for the withdrawal of the paint ladened air from the paint spraying chamber, a conveyor for said booth adapted to convey the articles to be painted, said conveyor being located between the dual slots and being at least partially recessed below portions of said subfloor, with said dual slots at the sides of said conveyor, whereby the airflow around the articles to be painted is improved; the conveyor is protected from overspray; and the booth has a more compact structure.

It is a primary object of the present invention to provide improved air flow around the articles being painted and into dual slots one or either side of the article being painted.

Another object of the present invention is to provide a more compact booth structure, the booth having a conveyor recessed between the dual slots.

Yet another object of the present invention is to shelter the booth's conveyor from paint overspray.

These and other objects of the present invention will become apparent from the accompanying drawings and the following written description.

DESCRIPTION OF THE PREFERRED EMBODIMENTS

Figure 1:
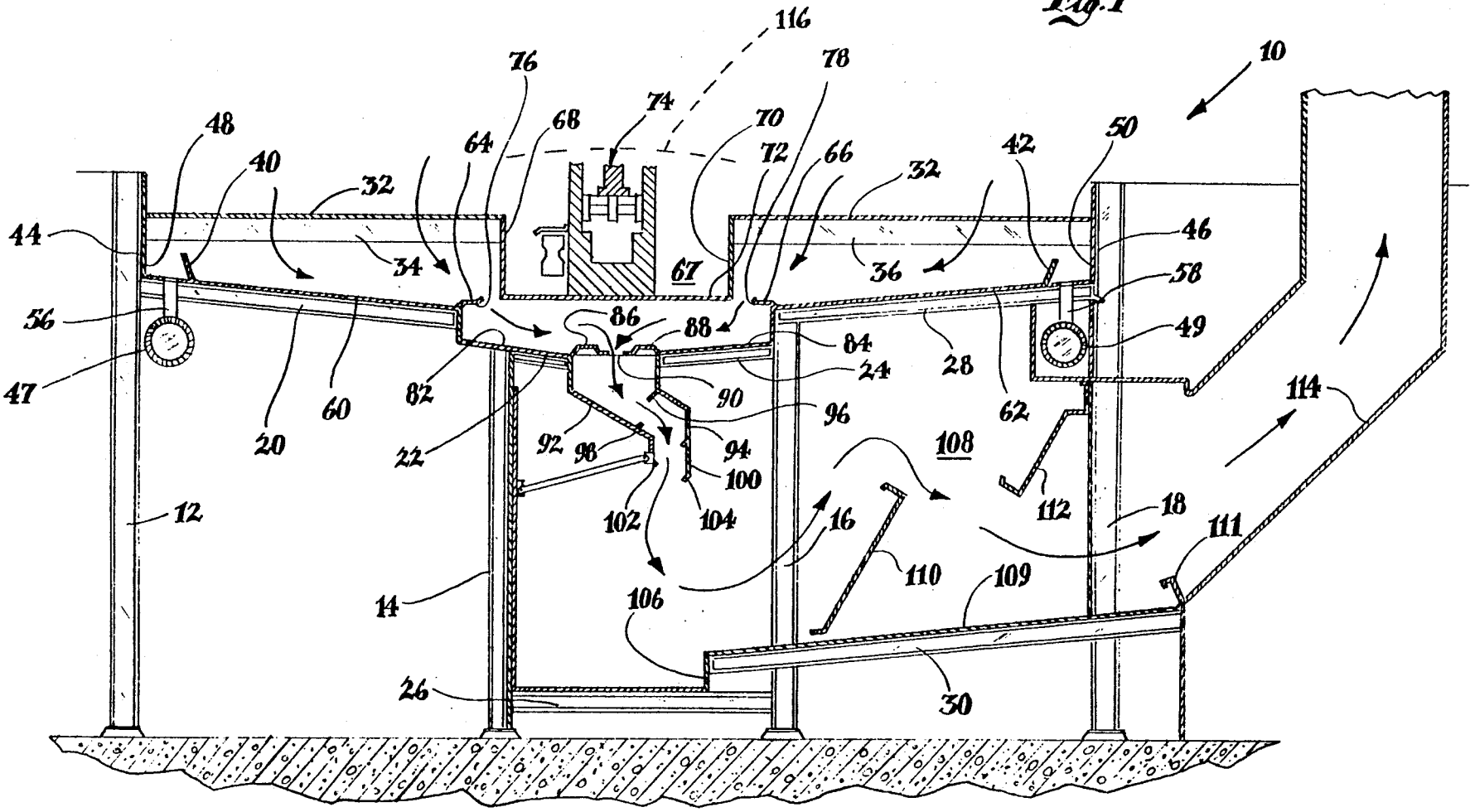
FIG. 1 is a cross-sectional view of a first embodiment of the present invention.

Referring to FIG. 1 the first embodiment for a paint spray booth having a subfloor arrangement 10 of a of the present invention is shown. The booth (only partially shown) has vertical structural members 12, 14, 16 and 18 holding up the booth and subfloor. Additional horizontal or inclined structural members 20, 22, 24, 26, 28 and 30 are provided. A grill 32 floor, if desired, for painting or maintenance, such as for workmen to stand on, can be provided and is supported by members 34 and 36, the grill floor being generally open to let paint ladened air pass therethrough. Below the grill floor 32, the water washed subfloor 10 is provided. Of course, if the grill floor is omitted, the subfloor would then become the floor. The subfloor 10 comprises a pair of side weirs 40 and 42 which cooperate with the lower portions of the booth walls 44 and 46 to form side troughs 48 and 50. In this instance, the side troughs 48 and 50 are supplied by a pair of water pipes 47 and 49, one at each side, and the vertical risers 56 and 58 being connected to the side troughs.

The subfloor 10 includes inclined, water washed sheets 60 and 62 which at their downward, inner ends have up lifting, spaced apart lips 64 and 66. Between the spaced apart lip 64 and 66 is a conveyor recess 67 formed by side walls 68 and 70 and a bottom 72, which contains a conveyor 74 for moving the articles to be painted. In addition, between the lips 64 or 66 and the side walls 68 or 70, the dual slots 76 and 78 are formed.

Beneath the dual slots 76 and 78 is, in this instance, a second set of inclined sheet 82 and 84 which feed into another pair of lips which, like lips 64 and 66, first rise and then fall and again rise to form there between a lower, single slot 90. From this point downward the washer and eliminator is generally similar to that shown in U.S. Pat. No. 4,328,012 and/or U.S. Pat. No. 4,521,227, having an angled left wall 92 which is hinged at the top and adjustable to very the gap with an angled right wall 94, the two walls carrying baffles 96, 98, 100 and lips 102 and 104.

Down below a sump 106 is formed, and off to the right, beneath the sheets 84 and 28, a water eliminator section or chamber 108 with a bottom inclined drain sheet 109 is provided having water collecting baffles 110 and 112. The lower end of the baffle 110 is spaced away from the sheet 109 to permit it to drain back to the sump 106. The air is drawn into an exhaust duct 114 by means, such as exhaust fans (not shown).

The operation of the embodiment 10 is as follows. Water is supplied from the pipes 47 and 49 to the side troughs 48 and 50 to overflow the weirs 40 and 42 and flood the inclined sheets 60 and 62. The water runs off sheets 60 and 62 and rushes over the lips 64 and 66 to form first curtains of water in the dual slots 76 and 78 as the water is thrown up against the side walls 68 and 70. To obtain the desired action these lips 64 and 68 are made adjustable, such as by slotted holes and bolts holding in place adjustable sheet metal portion forming the lips. The water drains off the side walls 68 and 70, down to the inclined sheets 82 and 88 to again rush over the second set of lips 86 and 88 and into the lower single slot 90. From there the water flows down the walls 92 or 94 and is thrown off the various baffles 96, 98 and 100 and lips 102 and 104 to form further curtains of water through which the paint laden air is drawn to be cleaned. The various curtains of water and water flow has been depicted in the drawings.

The painted ladened air's path is shown by the arrows. First, the air passes around the conveyed article being painted (not shown), passes through the grill floor, if one is present, and then passes into the dual slots 76 and 78 where the first cleaning action occurs. Then the air leaves the slots and passes through the curtains of water off the side walls 68 and 70 into the lower level, single slot 90 and through various curtains of water flowing off the baffles 96, 98 and 100 and lips 102 and 104. Here most of the water separates from the air and falls into the sump 106. The air, itself, then passes through the eliminator chamber 108, wherein most of the remaining water is collected on the baffles 110, 112 and 111 or walls of that chamber over sheet 109 and drains back to the sump 106.

The present invention, in addition to providing excellent cleaning of the air results in a more compact booth arrangement as the conveyor height above the ground is less as it is at least partially recessed into the subfloor. In addition better air flow is provided around the article being painted and around the conveyor. Further as the conveyor is covered at the top by the article being conveyed (represented by the dotted line 116) and the side walls 68 and 70 and bottom 72, less overspray tends to accumulate on the conveyor, and hence less maintenance on the conveyor is required.

Figure 2:
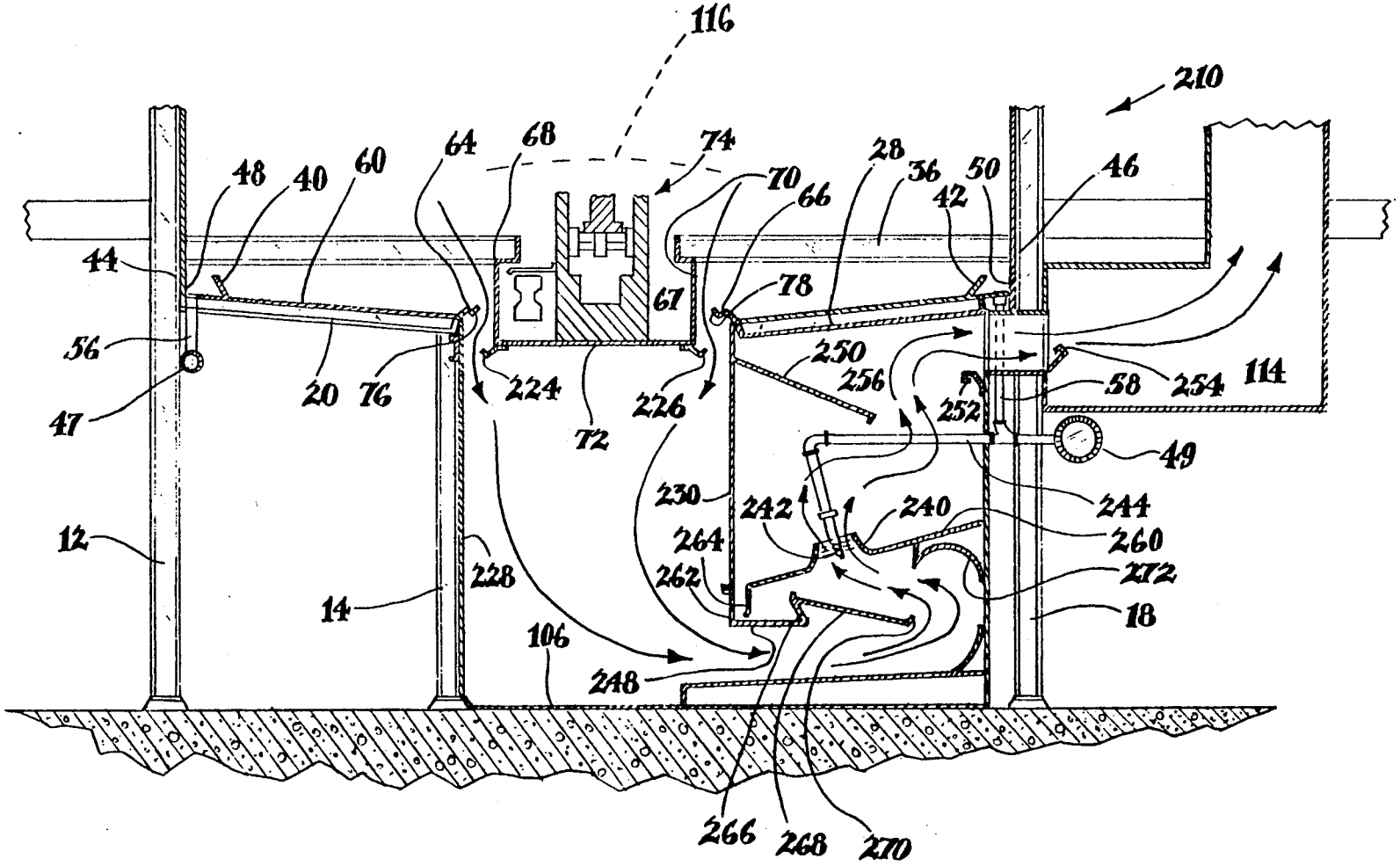
FIG. 2 is a cross-sectional view of a second embodiment of the present invention.

Referring to FIG. 2, a second embodiment 210 of present invention is shown. This embodiment above the subfloor 210 and the dual slots is generally similar to that shown in embodiment 10, and to the extent it is the same, the same reference numerals are utilized. Below the subfloor 210 and the dual slots 76 and 78 the embodiment 210 is different establishing that the present invention is adaptable to various type eliminator sections. Instead of having a single lower slot 90 as in FIG. 1, a second set of lips 220 and 222 are formed therebelow the first set lips 64 and 66 but on opposite sides and form two other lower dual slots 224 and 226. These lower dual slots cooperate with vertical walls 228 and 230 to create further washing action in the lower dual slots 224 and 226. The water from the slots 224 and 226 hits the walls 228 and 230 and then drains to the 106 sump. The air on the other hand flows into an eliminator section, such as that shown in the copending U.S. Patent application Ser. No. 07/528,110, filed May 23, 1990, entitled "Recirculating Water Washer Means and Method" and filed on the same date as the present application in the names of Steve E. Telchuk, Leslie H. Brown and Frank L. Dobias, the inventors. This eliminator section uses an air nozzle-water nozzle washer having an air nozzle 240 and water nozzle 242, the latter being supplied with water by a pipe 244 from the supply pipe 49. As can be seen, the paint ladened air from the two sets of dual slots can enter, via an opening 248 and is pulled into the air nozzle, past the baffles 250, 252 and 254 into the exhaust duct 114. The water from the water nozzle 242 is drawn through the air nozzle 240 and collects on the baffles 250, 252 and 254 and the walls of the chamber 256 containing the same, and then flows down or over the baffles to the sheet 260. From there the water collects and runs down the sheet 260 to an airlock 262 having a partition 264 and a weir 266. The water flows around the partition 264 and over the weir 266 and down the inclined sheet 268 and up its tip 270. From there the water is thrown up onto the curved baffle 272, and depending on the position of the curved baffle 272, some being thrown in front of the air nozzle 240 to be the drawn therethrough, and the most or remainder being thrown back onto the baffle 268 to again be thrown up to the curved baffle 272 and continuing to circulate in front of the air nozzle-water nozzle washer to provide cleaning action and greatly reduce the amount of water required by the air nozzle-water nozzle type washer. It is believed that the water nozzles water requirement can be cut in half and yet good cleaning of the air obtained by this recirculation of the water. The action is described in the above mentioned copending application.

Figure 3:
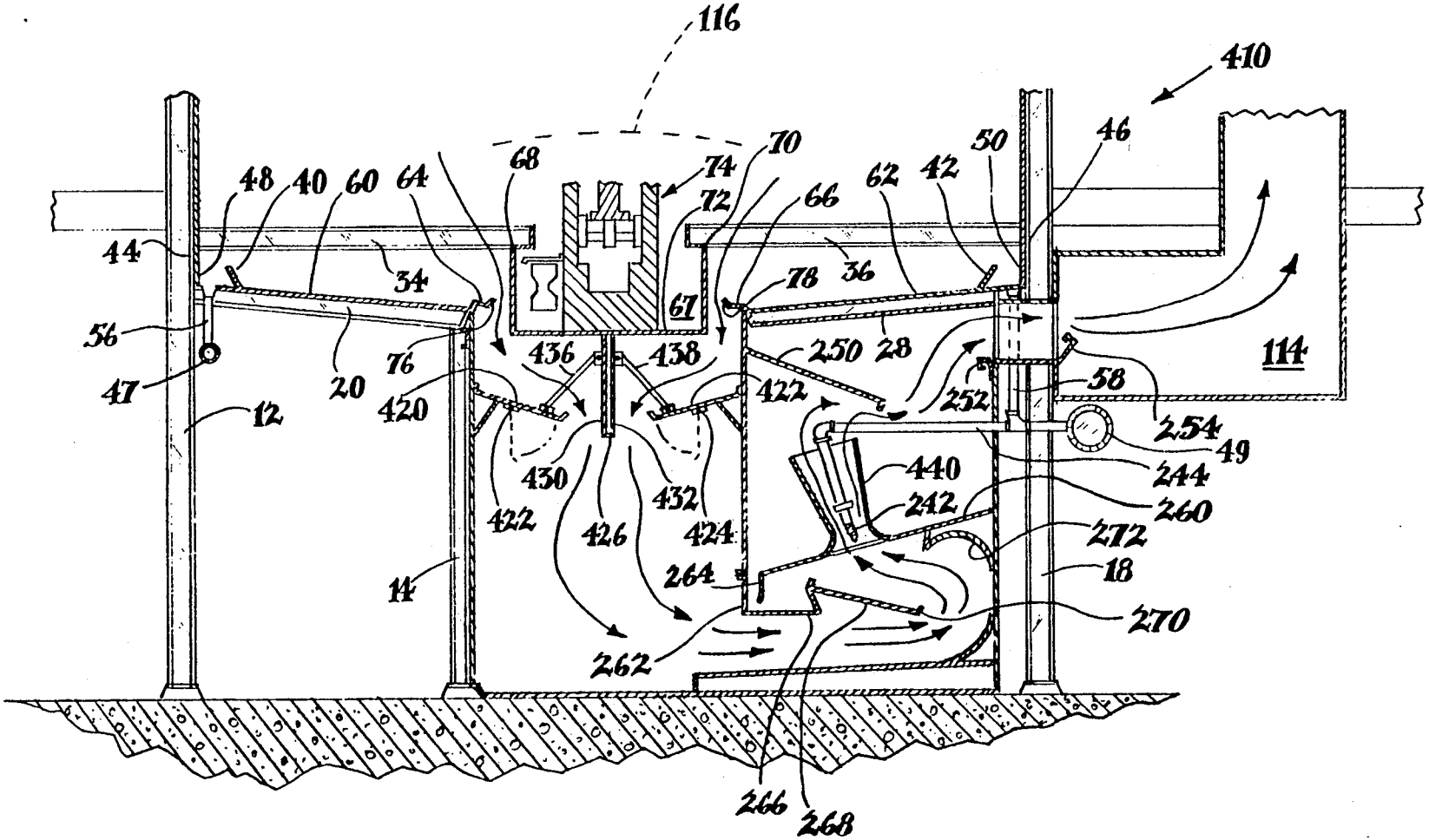
FIG. 3 is a cross-sectional view of a third embodiment of the present invention.

Referring to FIG. 3, a third embodiment of subfloor and dual slot arrangement 410 is shown. Again the structure of the embodiment 410 at and above the lips 66 forming the dual slots 76 and 78 is generally similar to that shown in FIGS. 1 and FIG. 2 and is given the same reference numerals. Below the first set of dual slots 76 and 78, the structure of FIG. 3 is somewhat similar to that shown in FIG. 2, and to the extent similar is given the same reference numerals as in FIG. 2. The main difference in the embodiments of FIGS. 2 and 3 is the structure providing the second set of dual slots below the first set of dual slots 76 and 78 and in the provision of a long converging-diverging air nozzle for the air nozzle-water nozzle washer.

As is shown, below the first set of dual slots 76 and 78 is provided side walls 228 and 230 which in FIG. 3 carry a pair of downwardly inclined baffles 420 and 422. The baffles are hinged as indicated at 424 to permit them to pivot at the point 424 downward for maintenance. These baffles 420 and 422 cooperate with a center partition 426 to form a second or lower pair of dual slots 430 and 432. The tips of the baffles 420 and 422 are adjustable in a manner similar to the tips 66 to vary the space at the slots so as to pinch off or open up the air flow therethrough. As is shown, the pivoting end of the baffles 420 and 422 may be held by supporting brackets 436 and 438. Alternatively, these supporting brackets could be made of a variable length to alter the position of the tips of the baffles 420 and 422 relative to the partition 426 to vary the size of the slots 430 and 432.

After leaving the second set of dual slots 430 and 432, the air flows to an air nozzle-water nozzle washer similar to that shown in FIG. 2. To the extent similar it is given the same reference numerals as in FIG. 2. However, unlike the air nozzle 240 in FIG. 2, the air nozzle 440 in FIG. 3 is of considerably longer length and has a throat (minimum internal dimension) smaller than its inlet or outlet. The longer air nozzle 440 is described in the copending Ser. No. 528,110 application, and is believed to result in better cleaning as the air and water flowing therethrough are held together for a longer period of time. Also the diverging downstream portion is believed to more efficiently recover or convert the previously accelerated air speed back to static pressure so as to minimize the pressure drop across the long air nozzle.

While the preferred embodiments have been illustrated and described, it should be appreciated that the dual slot concept subfloor arrangement of the present invention could be utilized in other conveyor type booths, be they manual paint spraying or automated paint spraying, such as using automatic machines or robots. Further, this dual slot subfloor concept could be utilized with other type washer or eliminator sections than those shown.

While the term subfloor is used in the claims, that term would also include the water washed floor to the booth where no grill floor is present above the water washed floor.

While several preferred embodiments of dual slot subfloor of the present invention have been illustrated and described, from the foregoing, it should be understood that variations, modifications and equivalent structure thereof fall within the scope of the appended claims.

What is claimed:

1. In a downdraft paint spray booth for cleaning paint laden air created during spray painting of an article, the booth having a spray painting chamber and means for moving paint laden air into and from said spray painting chamber, the improvement comprising a water washed subfloor below said spray painting chamber and extending from each side of said booth, a supply for supplying water to said subfloor, a conveyor for moving said article through said booth, said conveyor being at least partially recessed below said spray painting chamber and into said subfloor, dual slot openings in between the sides of said subfloor and said conveyor, a first washing means at said dual slot openings for said subfloor, whereby the paint laden air can flow around the article and the conveyor and into said dual slots to provide improved air flow around the article being painted, reduced overspray accumulation on the conveyor, and a more compact booth arrangement.

2. In a downdraft spray booth as in claim 1, wherein said dual slots are adjustable in size.

3. In a downdraft spray booth as in claim 2, further comprising a pair of adjustable baffles below said dual slots, said adjustable baffles being positionable into a first position to throw water from said dual slots into at least one water curtain to further clean the air, and being adjustable into another position to facilitate maintenance.

4. In a downdraft spray booth as in claim 1, wherein said dual slots are formed by downwardly extending portions having upwardly extending lips.

5. In a downdraft spray booth as in claim 1, further comprising a second set of dual slots below the first set of dual slots.

6. In a downdraft spray booth as in claim 5, wherein said second set of dual slots are formed by downwardly extending portions having upwardly extending lips.

7. In a downdraft spray booth as in claim 1, further comprising additional washer means below said dual slots.

8. In a downdraft spray booth as in claim 7, wherein said additional washer means comprises a single slot washer.

9. In a downdraft spray booth as in claim 7, wherein said additional washer means comprises a dual slot washer and an eliminator section downstream of said additional washer means.

10. In a downdraft spray booth as in claim 7, wherein said additional washer means comprises at least one air nozzle-water nozzle washer.

11. In a downdraft spray booth as in claim 10, further comprising an air nozzle of a converging diverging construction having a length at least twice as long as its throat dimension, whereby the air and water in the air nozzle are kept together for a long period of time to promote cleaning.

12. In a downdraft spray booth as in claim 10, further comprising means to recover some of the water from the water nozzle and means to recirculate the recaptured water in front of said air nozzle, whereby the water required for the water nozzle is reduced.

13. In a downdraft spray booth as in claim 12, wherein in said means to recover comprises means to collect the water from the downstream side of said air nozzle, air lock means to transfer the water from the downstream side to the upstream side of said air nozzle, and said means to recirculate includes a first baffle for throwing the water from said air lock into the air moving upstream and a second baffle for returning the water from said first baffle back to said first baffle.

* * * * *